US008710999B2

(12) United States Patent
Tas

(10) Patent No.: US 8,710,999 B2
(45) Date of Patent: Apr. 29, 2014

(54) EMERGENCY POWER-OFF BUTTON WITH PROXIMITY ALARM

(76) Inventor: Robert Tas, Aromas, CA (US)

( * ) Notice: Subject to any disclaimer, the term of this patent is extended or adjusted under 35 U.S.C. 154(b) by 378 days.

(21) Appl. No.: 13/159,570

(22) Filed: Jun. 14, 2011

(65) Prior Publication Data

US 2012/0319858 A1 Dec. 20, 2012

(51) Int. Cl.
*G08B 21/00* (2006.01)

(52) U.S. Cl.
USPC ..... 340/686.6; 340/686.1

(58) Field of Classification Search
USPC ..... 340/686.6
See application file for complete search history.

(56) References Cited

U.S. PATENT DOCUMENTS 4,996,819 A 3/1991 Davis
5,939,986 A * 8/1999 Schiffbauer et al. ..... 340/573.1
6,000,807 A 12/1999 Moreland
6,044,257 A 3/2000 Boling et al.
6,059,536 A 5/2000 Stingl
7,408,476 B1 8/2008 Beaton
8,063,790 B2 * 11/2011 Rothenberger ..... 340/686.6
8,115,650 B2 * 2/2012 Dasilva et al. ..... 340/686.6
8,248,263 B2 * 8/2012 Shervey et al. ..... 340/686.1
2008/0018472 A1 * 1/2008 Dasilva et al. ..... 340/572.4
2008/0030318 A1 2/2008 Roark et al.
2010/0102991 A1 * 4/2010 Hernandez Gonzalez et al. ..... 340/944
2010/0289662 A1 * 11/2010 Dasilva et al. ..... 340/686.6

* cited by examiner

*Primary Examiner* — Travis Hunnings
(74) *Attorney, Agent, or Firm* — Chris R. Schmidt

(57) ABSTRACT

An emergency power off system is provided including an emergency power off button, a proximity sensor, and alarm connected to the proximity sensor, wherein the proximity sensor is configured to detect an object within a predetermined distance from the power off button, and further wherein the proximity sensor is configured to activate the alarm when an object is within a predetermined distance from the power off button.

4 Claims, 2 Drawing Sheets

EMERGENCY POWER-OFF BUTTON WITH PROXIMITY ALARM

FIELD OF THE INVENTION

The present invention relates generally to manufacturing equipment and computer systems and related safety hardware, and more specifically to an emergency power-off button combined with sensors and/or alarms to alert nearby personnel of imminent contact with an emergency power-off button.

BACKGROUND OF THE INVENTION

Manufacturing equipment and other mechanical and electrical systems generally make use of an Emergency Power Off or "EPO" button to enable a quick and safe power down of equipment or systems in the event of an emergency to protect nearby personnel and associated equipment. A variety of causes might trigger the need to use engage an EPO button, such as earthquakes, fire, floods, mechanical or electrical systems failure, human operator error, or even the mere suspicion of an unsafe condition may require triggering an EPO button to prevent any chance of injury or damage occurring.

In certain manufacturing and other environments there exists a close proximity between persons engaged in operating or using the equipment and the EPO button location. This is often an intentional part of the system design so as to promote easy access to the button in case of an emergency.

A need therefore exists an improved emergency power off button and system that overcomes the limitations of the prior art. Specifically, there is a need for an EPO button and system that effectively warns nearby individuals and prevents accidental activation of EPO button in order to increase system uptime and efficiency.

SUMMARY OF THE INVENTION

One embodiment of this invention provides an emergency power-off button in combination with a proximity sensor and a visual alarm, wherein the proximity sensor is configured to detect the presence of objects near to the emergency power-off button and, once detected, to activate a visual alarm to alert nearby persons of potential imminent contact with the emergency power-off button.

Another embodiment of this invention provides an emergency power-off button in combination with a proximity sensor and an audible alarm, wherein the proximity sensor is configured to detect the presence of objects near to the emergency power-off button and, once detected, to activate an audible alarm to alert nearby persons of potential imminent and contact with the emergency power-off button.

DESCRIPTION OF THE PREFERRED EMBODIMENTS

One embodiment of the invention provides a method of preventing accidental activation of an emergency power off or emergency stop button.

In one embodiment, an emergency power off or EPO button is surrounded by a protective shroud to reduce the chances of accidental contact with the button, and a proximity sensor is configured to detect the presence of persons or objects within 1.0 meter of the button. In another embodiment, the proximity sensor is configured to detect objects within 0.5 meter, and in other embodiments within 2 meters of the EPO button. In a preferred embodiment, the proximity sensor is configured to activate an audible alarm when the proximity sensor is activated in order to alert persons near the EPO button that imminent and potentially accidental contact with the EPO button may occur, which would trigger unwanted shut down of operating equipment.

In another embodiment, the proximity sensor is configured to activate a visual alarm when the proximity sensor is triggered, such as a flashing light, a light bar, a rotating light, or an indicator on a computer screen. In some embodiments the proximity alarm may be used to adjust the overall lighting conditions the room, such as by increasing the power or decreasing the power to the primary lighting in order to alert persons near the EPO button that accidental contact with the EPO button may occur. In another embodiment, the proximity sensor may be configured to activate a vibrating alarm when the proximity sensor is triggered, such as a vibrating floor, a vibrating hand-held device, or a vibrating cell phone or other communication device. Additionally, any or all of these warning devices may be combined together to improve the method of alerting nearby persons, such as by combining a light-based visual warning with an audible alarm, or by combining a vibrating and visual alarm, and so on. Vibrating alarm systems may be formed by placing an unbalanced shaft on a motor and operating the motor at a predetermined frequency, for example between 1 Hz and 50 Hz, and more specifically between about 5 Hz and 30 Hz to improve the ability of persons to detect the alarming vibration.

The proximity sensor used in combination with the EPO button may be comprised of a light curtain, such as the C4000 Safety Light Curtain™ manufactured by SICK AG Safety Systems. In other embodiments, the proximity sensor may be comprised of a safety light grid, such as the SLP series light grid manufactured by Visolux™, or a photoelectric switch as commonly known in the art. In other embodiments, a laser based proximity sensor may be employed for spanned longer distances.

Figure 1:
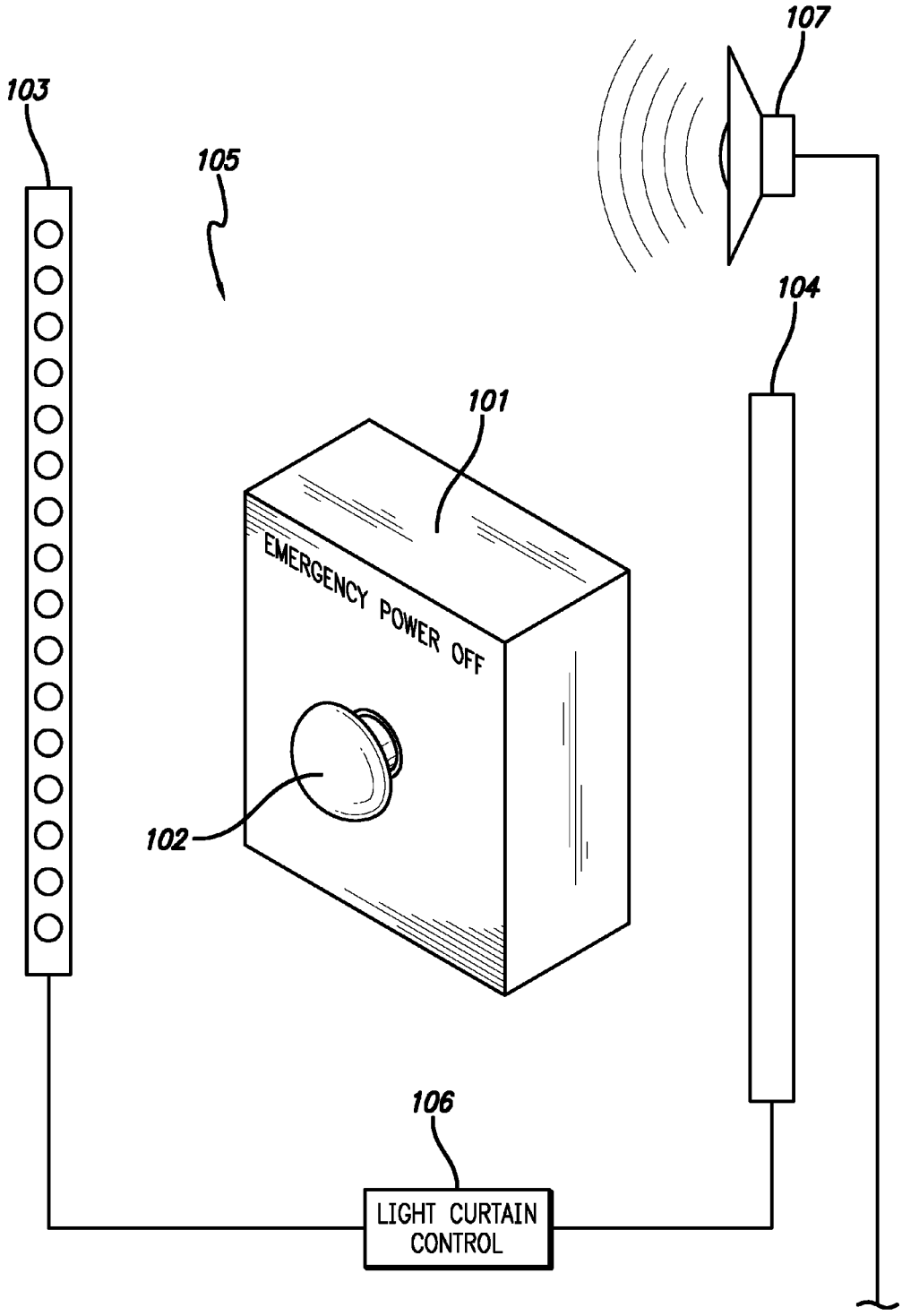
FIG. 1 is a schematic view of an EPO system according to one embodiment of the invention.

Several example embodiments will now be described in more detail. FIG. 1 is a schematic view of an EPO button with combined proximity sensor and alarm system. Housing 101 provides a protective structure for EPO button 102. The EPO button may be a toggle switch, push-button switch, or rotating switch. In a preferred embodiment the EPO button is a push button switch for rapid activation in the event of an emergency. Light emitting bar 104 is aligned with light-sensing bar 103 to form a light-curtain 105 that is interrupted by objects within in its path, and this interruptions signals the light-curtain control circuitry 106 to activate an alarm 107. In one embodiment the C4000 Safety Light Curtain™ functions as elements 103 and 104. Alarm system 107 may be an audible alarm, such as a loudspeaker. In other embodiments, alarm system 107 is replaced by a combination of audible and visual alarms, or with a combination of audible, visual, and vibrating alarm systems.

Figure 2:
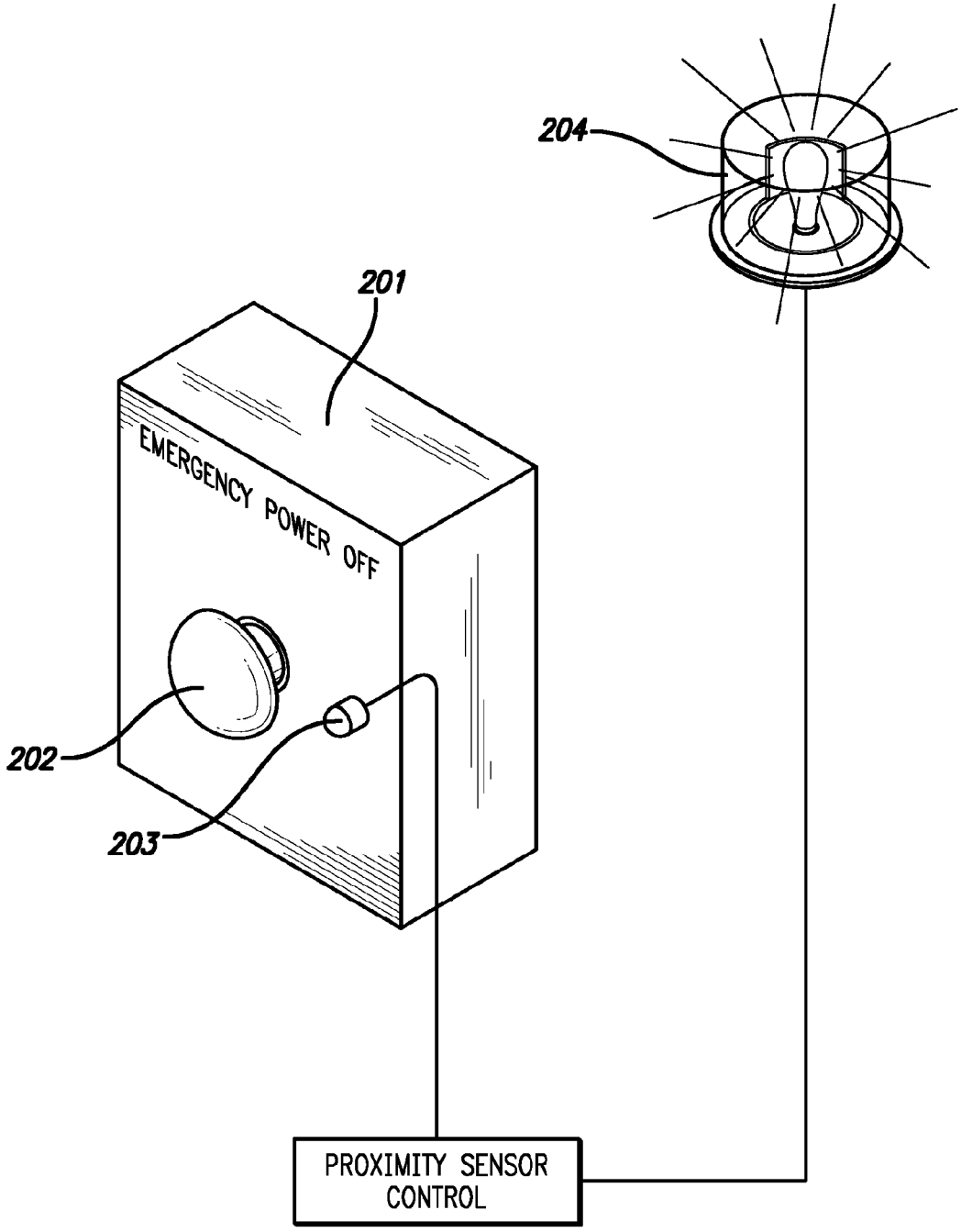
FIG. 2 is a schematic view of an EPO system according to one embodiment of the invention.

FIG. 2 is a schematic view of an EPO button with combined proximity sensor and visual alarm system. Housing 201 provides a protective structure for EPO button 202. The EPO button may be a toggle switch, push-button switch, rotating switch, or other switch that can be readily activated by a human hand. In a preferred embodiment the EPO button is a mechanical push-button switch. Proximity sensor 203 is directed away from the EPO button, and is configured to detect nearby objects. In one embodiment, the detection distance can be adjusted by the proximity sensor control until 205. Exemplary proximity sensors include a laser-based sensor, for example the W8 Laser manufactured by the SICK™ Corporation. Alarm system 204 may be a visual alarm, such as a rotating or flashing light. In other embodiments, alarm system 204 is replaced by a wireless transmitter that functions to activate other alarm systems, such as an indicator on a computer screen, or a handheld device carried by personnel working on the nearby equipment.

Optionally, one or more proximity sensors may be used to detect the presence of a human or object near the emergency power off button. In one embodiment, a first proximity sensor is configured to activate a first alarm when a human presence is with two meters of the emergency off button, and a second proximity sensor is configured to activate a second alarm system when a human presence is within one meter of the emergency off button. In this example, a light curtain is used to activate a low-frequency flashing light, such as a colored light flashing at a frequency of 50 Hz and a radiant flux of 1,000 lumens when a person or object comes is located within 2 meters of the EPO button, and a second proximity sensor such as a multi-beam photoelectric switch is configured to activate a flashing white light at a frequency of 100 Hz and a radiant flux of 2,000 lumens when a person or object comes within 1 meter of the EPO button. In this example, the dual proximity sensor configuration provides a way to create a gentle alert when a person or object is beginning to approach the EPO button at a distance of 2 meters, and a stronger and more emphatic warning when a person or object is within 1 meter of the EPO button.

It is to be understood that the present invention is not limited to the embodiments and the examples described above and illustrated herein, but rather encompasses any and all variations falling within the scope of the appended claims. For example, as is apparent from the claims and specification, not all method steps need be performed in the exact order illustrated or claimed, but rather in any order that allows the proper formation of the EPO system of the present invention.

What is claimed is:

1. An emergency power off system, comprising:
an electrically powered device;
an emergency power off button;
a proximity sensing device;
an alarm system comprising a visual alarm; and,
wherein the proximity sensing device is configured to detect an object within a predetermined distance from the EPO button, further wherein,
the alarm system is configured to activate when the proximity sensing device detects an object within a predetermined distance from the EPO button, and further wherein,
the visual alarm comprises an indicator on a computer screen.

2. The emergency power off system of claim 1, wherein the indicator on a computer screen is selected from the group comprising a flashing icon, a color changing icon, a pop-over icon, or a change in the background color of the computer screen.

3. An emergency power off system, comprising:
a manufacturing machine;
an emergency power off button;
a proximity sensing device;
an alarm system comprising a visual alarm; and,
wherein the proximity sensing device is configured to detect a human presence within a predetermined distance, further wherein,
the alarm system is configured to power on when the proximity sensing device detects a human presence within a predetermined distance, and further wherein,
the visual alarm comprises an indicator on a computer screen.

4. The emergency power off system of claim 3, wherein the indicator on a computer screen is selected from the group comprising a flashing icon, a color changing icon, a pop-over icon, or a change in the background color of the computer screen.

* * * * *